US006349517B1

(12) United States Patent
Manley et al.

(10) Patent No.: US 6,349,517 B1
(45) Date of Patent: Feb. 26, 2002

(54) FIXED BARRIER MODULE

(75) Inventors: Alan Manley, Croydon; Mike Wheeler, Haywards Heath, both of (GB)

(73) Assignee: Cubic Corporation, San Diego, CA (US)

( * ) Notice: Subject to any disclaimer, the term of this patent is extended or adjusted under 35 U.S.C. 154(b) by 0 days.

(21) Appl. No.: 09/539,142

(22) Filed: Mar. 30, 2000

(51) Int. Cl.[7] ..... E04C 2/52

(52) U.S. Cl. ..... 52/239; 52/220.7; 52/238.1; 52/71; 160/135

(58) Field of Search ..... 52/71, 220.7, 238.1, 52/239, 220.2, 243; 160/135; 174/48

(56) References Cited

U.S. PATENT DOCUMENTS

| | | | | |
|---|---|---|---|---|
| 3,841,042 A | | 10/1974 | Siegal | |
| 4,196,555 A | * | 4/1980 | Henges, Jr. | 52/588 |
| 4,197,685 A | * | 4/1980 | Goulish | 52/239 |
| 4,370,008 A | | 1/1983 | Haworth et al. | |
| 4,375,010 A | * | 2/1983 | Mollenkopf | 174/48 |
| 4,936,066 A | | 6/1990 | Rütsche et al. | |
| 5,125,201 A | | 6/1992 | Pieters et al. | |
| 5,159,793 A | * | 11/1992 | Deugo | 52/126.1 |
| 5,277,512 A | | 1/1994 | Dwillies | |
| 5,381,994 A | | 1/1995 | Welch | |
| 5,502,938 A | | 4/1996 | Backer | |
| 5,806,258 A | | 9/1998 | Miedema et al. | |
| 5,905,229 A | * | 5/1999 | McKitrick | 174/48 |

FOREIGN PATENT DOCUMENTS

| | | |
|---|---|---|
| DE | 91 12 626 | 1/1992 |

* cited by examiner

*Primary Examiner*—Carl D. Friedman
*Assistant Examiner*—Jennifer I. Thissell
(74) *Attorney, Agent, or Firm*—Brown, Martin, Haller & McClain

(57) ABSTRACT

A fixed barrier module includes a support post for supporting two adjacent panels each of which are hingeable. A cut-away portion in a base portion of the support post accepts two cable-carrying swivel joints that are utilized as cable conduits through the support post. The swivel joints rotate with the panels, and allow cables to follow the fixed barrier contour. Cable carrier extrusions attach to the swivel joints to extend the cable conduit below a panel section and to an adjacent support post. The swivel joints and hingeable panels allow the fixed barrier to change direction to follow any desired contour using a single-type of a support post.

20 Claims, 5 Drawing Sheets

FIXED BARRIER MODULE

BACKGROUND OF THE INVENTION

The present invention relates generally to fixed barriers, and more specifically to a module barrier system having hingeable panels and cable-carrying castings and extrusions that provide a barrier for any contour and that may be installed with minimal disruption to business services.

Modular barrier systems are known in the art for use as permanent or non-permanent dividers. In mass transit stations, fixed barrier systems channel passengers to gated entrances to ensure that payment is made for the transport service. Free-standing barrier systems of the prior art provide a convenient and cost-efficient alternative to erecting a permanent wall. A typical modular system is constructed with panels that fit into connecting spines. Spines are available in differing spine types to connect panels at specific angles. For example, a first spine may have slots 180 degrees apart for providing a straight connection, a second spine may have slots 90 degrees apart to provide a corner connector, and a third spine type may have four slots on all sides of the spine for connection of four panels. Absent the availability of custom made spines, these type of panel systems do not allow "odd" angle panel connections that may be necessary to follow the outline of a desired wall plan.

Transit system barriers typically are used to channel passengers to fare gates that require power cable and signal cable connections. Thus, it is desirable to include an area within or adjacent the barrier for running cables to the fare gates. The panels of some prior art systems are raised to provide an area for running cables along the floor with a baseboard cover providing protection from the panel base to the floor. Other systems provide holes through the spines that allow cables to be thread through the spines from panel to panel. Other portable and/or semi-permanent barrier systems do not provide an area for cables. Thus, the cables must be installed underground or overhead resulting in expensive and disruptive barrier installations.

The prior art systems providing baseboard cable areas present a number of disadvantages. Baseboard cable areas do not provide sufficient protection for data and power cables in a business environment, such as a transit system, that exposes the barrier modules and cables to outside environmental conditions. Cables lying along the ground are exposed to water and dirt and other contaminants that may damage the cables. In addition, any movement of the panels may cause the panel spines or baseboards to pinch, short, or sever the cables. Baseboard cable installation also has a disadvantage of possible data signal interference that may result from bundling power cables and data cables. The prior art panel systems also do not provide sufficient clearance for multiple cables, and replacement of cables is difficult because the cables are bundled or randomly piled, and are not easily accessible.

Both portable and permanent barrier systems of the prior art present disadvantages for the transit system environment. Portable panels of the prior art that cannot be mounted to floors present opportunities for vandalism or unauthorized movement of panel sections. Permanent barrier systems are expensive and require disruption of business operations during installation. In addition, once permanent barrier systems are in place, the location of the panels and the fare gates cannot be moved easily. Thus, a need remains for a hingeable fixed barrier with a protected cable-carrying channel for providing a system that may be erected to match any desirable barrier contour.

SUMMARY OF THE INVENTION

It is an advantage of the present invention to provide a hinged joint to enable a series of fixed barrier modules to change direction utilizing a single support post type.

It is another advantage to provide a fixed barrier that provides a cable carrier channel for accepting and enclosing power and signal cables.

It is still another advantage to provide a support post having cable-carrying hinge castings for carrying the power and signal cables through the support post.

It is a further advantage to provide a fixed barrier system that may be installed with minimal disruption to transit or other business operations.

The fixed barrier of an exemplary embodiment provides a means of preventing passengers from entering a secure side of a pedestrian area, such as a paid area of a transit station, other than by using an automatic gate or by using a manually operated gate which is under the control of a revenue operator. The fixed barrier is a series of barrier modules that are constructed from panels connected to hinging post extrusions and swivel joint castings. The hinging sections allow the fixed barrier to be angled along any area to be bounded utilizing a universal, i.e. a single type, hinging post.

The fixed barrier of the exemplary embodiment further provides a conduit, or channel, for holding and enclosing multiple cables, including power cables and signal cables. The cable conduit includes a cable carrier section below each panel section that connects to swivel joint castings within the hinging posts that are adjacent each panel section. The channel protects the cables from exposure to the environment, thus eliminating the need for installing the cables underground or overhead. Two swivel joint castings having hollow conduit structures are positioned in a base portion of the hinging post to carry the cables from the carrier section below one panel section into the carrier section of an adjacent panel section. The swivel joint castings sit on a hinge pins that allow the joints to rotate 45 degree angle to the front or the back of a center line of the hinging post. The hollow interior of the joint castings allow cable bundles to bend with the fixed barrier without pinching and tangling the individual cables. The hinged joint castings and panel sections are fitted to rotate cooperatively on the hinging post.

In an exemplary embodiment of the present invention, the swivel joint castings and carrier sections provide separate trays for cable types. For example, a top cable tray may be utilized for power cables, and a bottom cable tray may be utilized for signal cables. This feature of the fixed barrier reduces possible signal interference between the power and signal cables. In other embodiments of the invention, the swivel joint castings and carrier sections may provide multiple trays to separate a variety of cable types.

The fixed barrier of the exemplary embodiment consists of panels supported by vertical upright aluminum posts. Aluminum posts provide a light-weight, yet sturdy, barrier structure that withstands environmental conditions such as humidity, rain, and dust. Other embodiments of the present invention may utilize posts constructed from other suitable materials such as plastics and stainless steel. Likewise, the panels of the exemplary embodiment are glass or clear plastic, but may be made of other materials. The panels are fitted with panel carrier holders, or extrusions, that are clasped onto the panels along a vertical panel edge. The panel carrier extrusions abut the posts and are held between two hinges attached to an upper portion and a lower portion of the post. Each panel carrier extrusion and attached panel rotates on hinge pins that are inserted through the hinges into hinge pin holes located on the panel carrier extrusion. Thus, each panel section is hingeable to any desired angle, limited only by an allowable range of motion of the hinge and panel carrier extrusion.

The support posts of the exemplary embodiment are generally oval shaped having cut-away sections including tapped extruded holes and "v"-shaped hinge insets. Additionally, the center portion of the support posts of the exemplary embodiment includes an "h"-shaped cavity between the tapped extruded holes and hinge insets. The cavity decreases the weight and the quantity of material needed for each support post. Each support post has a center portion removed at the bottom end of the post to allow insertion of two swivel joint castings. The joint castings are hollow to allow signal and power cables to pass through the support post. Each joint casting rotates on a hinge pin in cooperation with a panel carrier extrusion. The joint casting also provides added support for the panel carrier extrusion. In the exemplary embodiment, the joint casting may be rotated up to 45 degrees in front of or behind a horizontal center line of the post. This rotational range allows a first barrier panel to be positioned up to 90 degrees from the adjacent second barrier panel. For example, to provide a 90 degree turn of the barrier line, a middle post is positioned at 45 degrees with respect to a first and second adjacent post, and each of the swivel joints are rotated to the maximum of 45 degrees. In other embodiments, the hinge casting may be constructed to allow a larger or smaller rotational range.

Two long steel bolts are screwed into the tapped extruded holes at the base of the post in order to affix the post to a bolt down plate. The bolt down plates provides fixing points for attaching the fixed barrier to a floor. In an exemplary embodiment, floor bolts or studs are utilized for attaching the fixed barrier to a floor. To maintain the strength of the post, the steel bolts extend beyond the joint casting cut away area of the post. In other embodiments, the steel bolts may extend to any height along the length of the post.

The panel carrier extrusion of the exemplary embodiment is generally rectangular and has two flanges on a distal end for clamping the panel, and a circular hinge section with a hinge hole on a proximal end. The panel extrusions are fitted to the panels utilizing silicon rubber to ensure a cushioned fit. To suspend the panel carrier extrusion and panel between the two hinges, a small portion of the carrier extrusion circular hinge section is removed. The remaining circular hinge section is placed against the opening of the "v"-shaped hinge inset in the post in order to align the hinge with the hinge pin hole of the panel carrier. Hinge pins hold the carrier extrusion and the attached panel in position on the post. The post hinges are positioned in the "v"-shaped hinge insets of the post, and are held in place using jacking screws.

The fixed barrier of the exemplary embodiment further includes cable carrier sections positioned below each panel and aligned with the joint castings. Each carrier sections includes a tray panel for holding the cables, and a cover panel for enclosing the cables. The carrier section is fitted onto pins pushed into the adjacent joint casting. The mated tray and cover panels of the carrier section form a trough for accepting the bottom edge of a panel. The exemplary embodiment further includes a retaining plate fitted in the trough below the bottom edge of the panel for holding the tray panel and cover panel together. Thus, the combination of the main post, joint castings and carrier sections form a gap-free barrier module.

The fixed barrier is constructed to be installed quickly and easily. In an exemplary embodiment, a first barrier section is installed adjacent a fare gate. A main post is affixed to a bolt down plate. The swivel joint castings then are fitted at the base of the main post on hinges that are inset into the bolt down plate. A first hinge is attached to the main post proximate the top of the swivel joint casting using jacking screws. Next, a carrier extrusion is fitted on top of a hinge pin that is inset into the casting top to extend upward through the first hinge and carrier extrusion hinge pin hole. An upper hinge pin is fitted proximate the top of the main post, and an upper hinge pin is inserted through the upper hinge and extended downward into the hinge hole of the carrier extrusion. The post is bolted to the floor at a correct pitch. The panels are inserted into the carrier extrusions, and a security bolt is placed through the carrier extrusion and panel to ensure that the panels are not dislodged or removed from the carrier extrusion. Next, the tray panel of the cable carrier section is fitted onto pins that are pushed into the swivel joint casting. The cable carrier section and panel are rotated to a desired angle. A second post is erected similarly adjacent the end of the cable carrier section. Once the cable carrier section is secured to the second post, the cables are run from the transit gate through the swivel joint casting of the first post and along the cable tray panel through the second post. The cover panel of the cable carrier section is fitted to the tray panel. The exemplary embodiment utilizes a plastic cap on the top of the main post to complete a barrier module section. Barrier module sections are added in a similar manner until the fixed barrier is complete along a desired contour.

The fixed barrier design of an exemplary embodiment of the present invention provides an installation package that minimizes disruption to stations and operators. Specifically, the design of the barrier enables installation of an automatic fare collection system without a need to excavate a transit station concourse for the fitting of cables to automatic fare collection gates. A universal main post hinges adjacent panel sections to allow the barrier to follow any desired contour. Cable-carrying swivel joints fitted to the universal main posts provide protection for the cables, and allow the cables to be bent to follow the angled barrier panel sections.

BRIEF DESCRIPTION OF THE DRAWINGS

The present invention will be better understood from the following detailed description of a first embodiment of the invention, taken in conjunction with the accompanying drawings in which like reference numerals refer to like parts and in which.

DESCRIPTION OF THE PREFERRED EMBODIMENT

Figure 1:
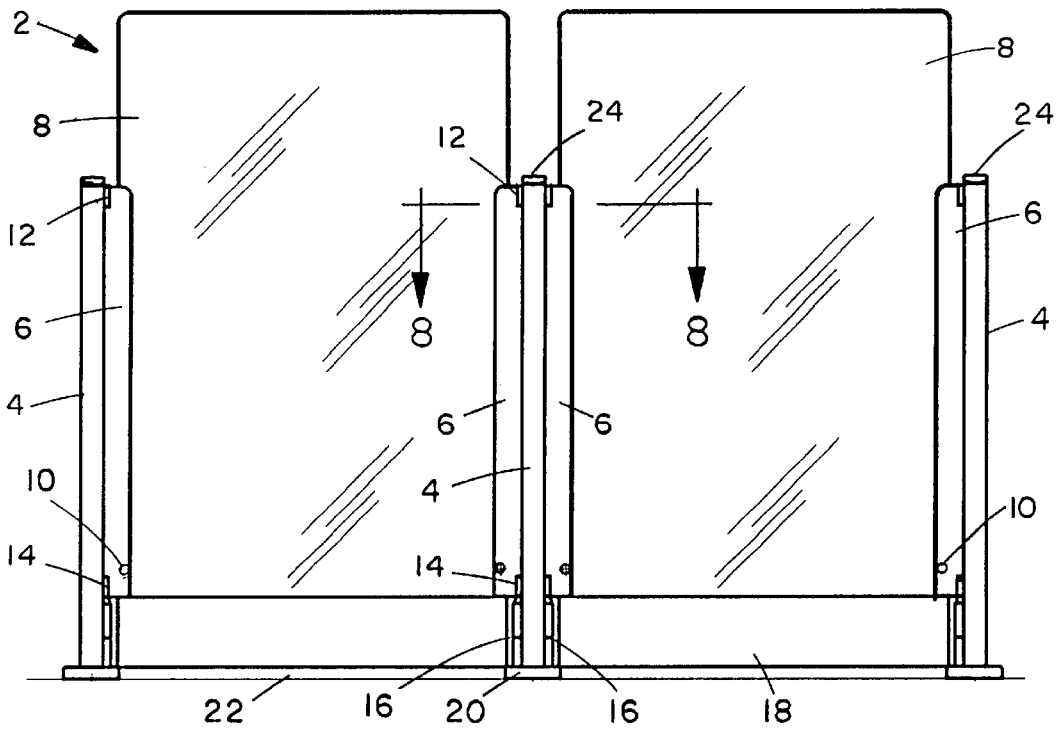
FIG. 1 is an illustration of two fixed barrier sections.
Figure 6:
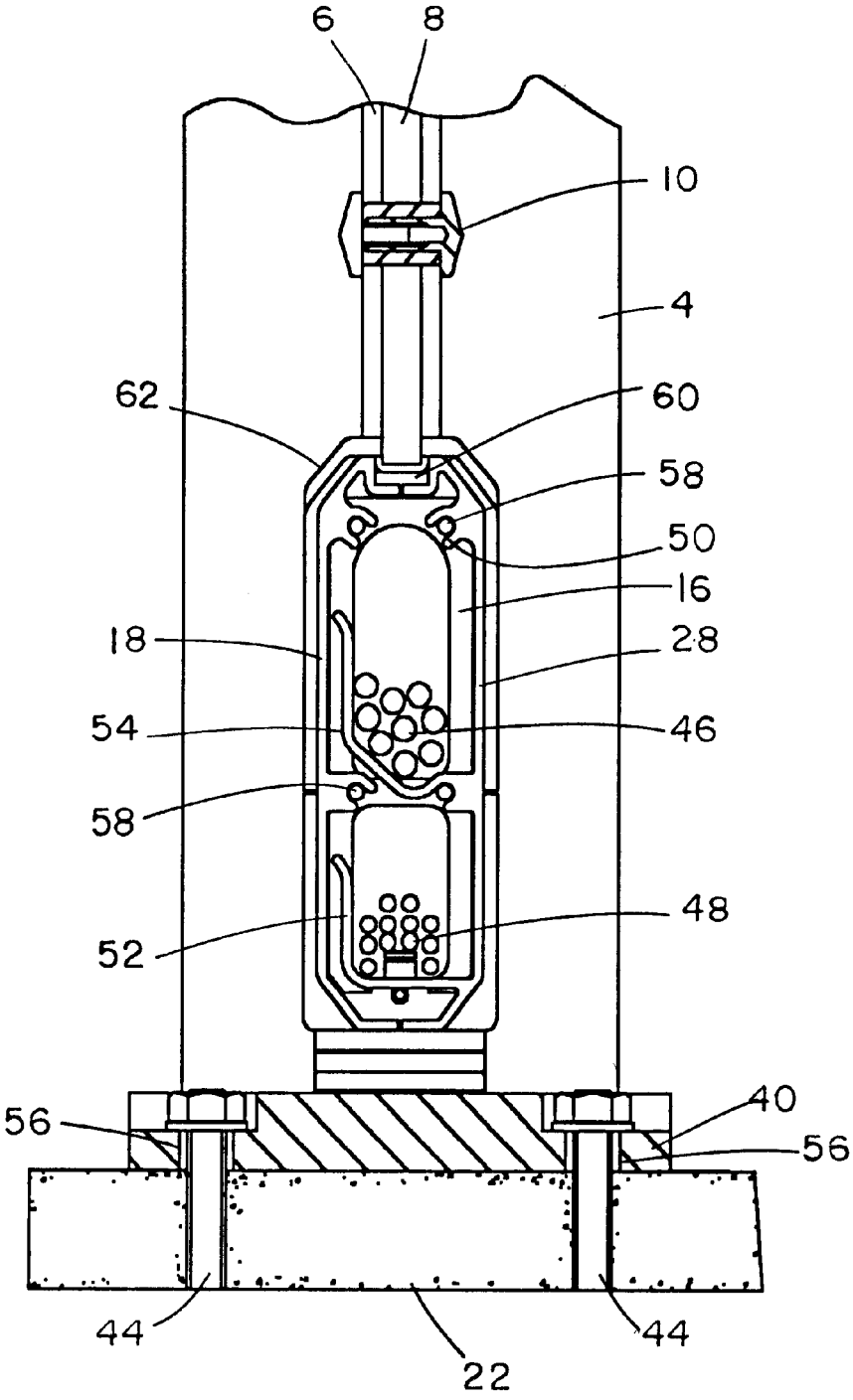
FIG. 6 is a cut-away section of a cable carrier extrusion fitted to a swivel joint casting and floor fixtures.

FIG. 1 illustrates two modular sections of a fixed barrier 2 of a preferred embodiment. Each modular section includes a panel section 8 supported by a main post 4 on either side of the panel section 8. In a preferred embodiment, the panel section 8 is constructed of clear material such as glass or plexiglass. Other embodiments of the present invention utilize opaque panel sections 8 made from alternate materials such as metals, woods, fabrics and plastics, or combinations thereof. The panel sections 8 are held in position by glass carrier extrusions 6 that are hingedly attached to the main posts 4 at an upper hinge pin support 12 and an intermediate hinge pin support 14. Each panel section 6 may be positioned up to 90 degrees from an adjacent panel section 6. Security screws 10 are provided to prevent the panel sections 8 from being disengaged from the glass carrier extrusions 6. FIG. 6 illustrates a side view of the security screw 10 through the panel section 8 and glass carrier extrusion 6.

Figure 5:
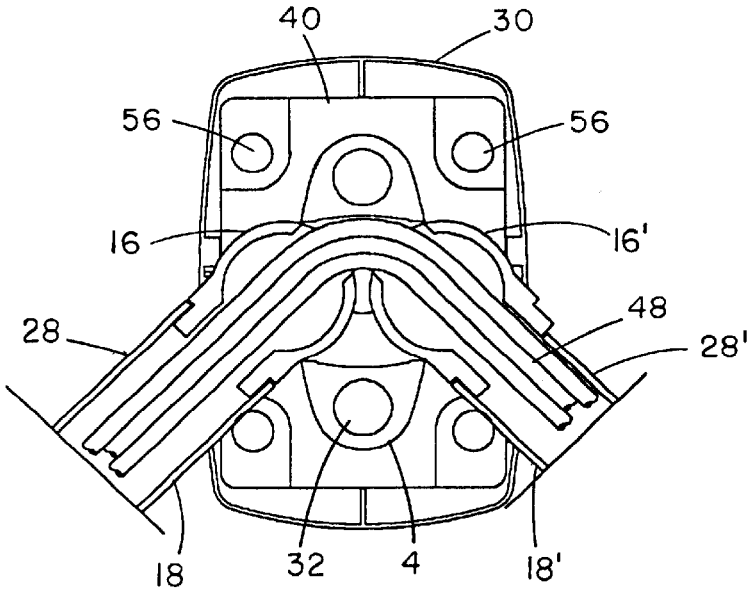
FIG. 5 is a cut-away section of a cable-run through swivel joint castings in a post.

Referring back to FIG. 1, the main posts 4 are secured to a bolt down plate assembly 20 that includes floor bolt fixing holes 56, as shown in FIG. 5. In a preferred embodiment, the main posts 4 are constructed of aluminum. The main posts of other embodiments may be constructed of suitable material such as metals and plastics. The main posts 4 are capped by a top plate and cap 24. Swivel joint castings 16 are fitted at the base of the main post 4. The swivel joint castings 16 rotate on hinge pins inserted into the base plate assembly 20. Cables may be run through the swivel joint castings 16 into a cable channel below each panel section 8. A cable carrier cover 18 encloses the cables.

Figure 2:
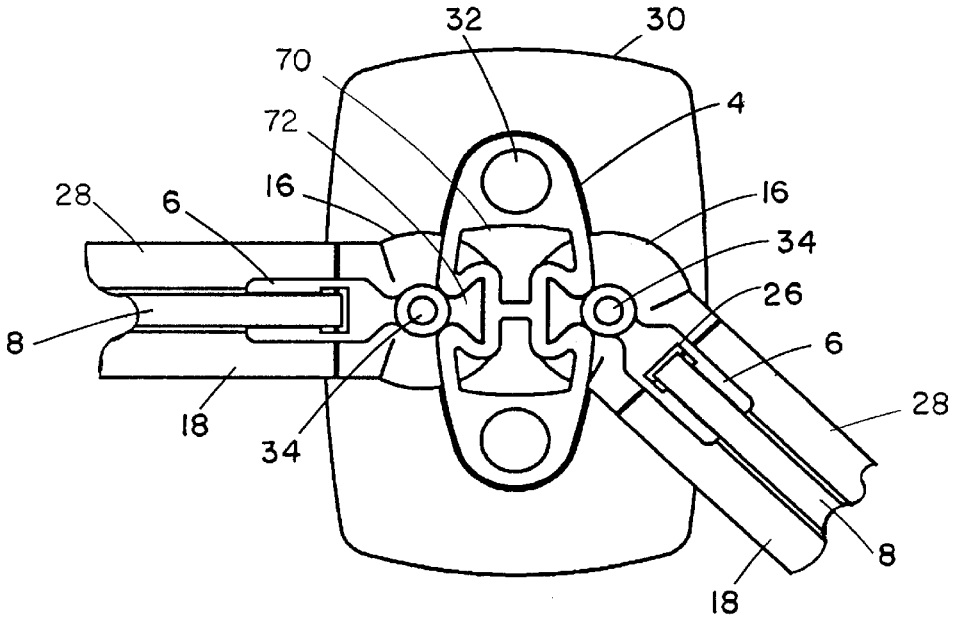
FIG. 2 is an illustration of swivel joints positioned in a post.
Figure 7:
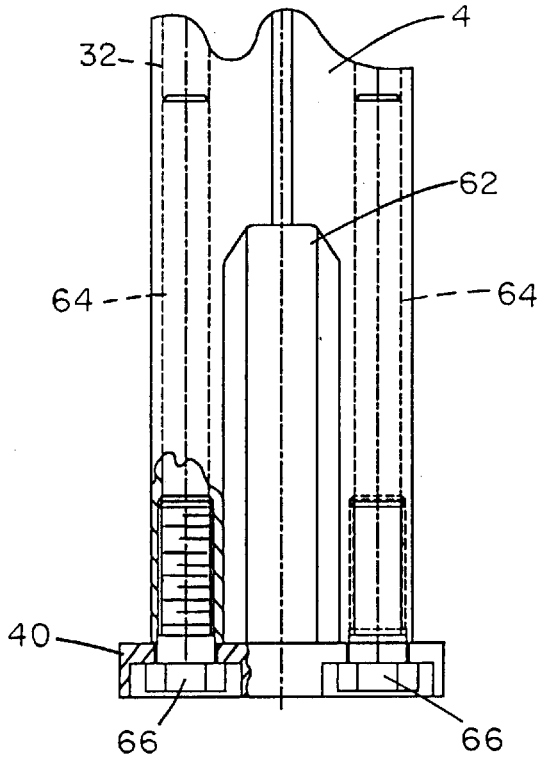
FIG. 7 is an illustration of an attachment of a bolt down plate to a main post.

FIG. 2 illustrates a top view of a main post 4 and adjacent panel sections 8 of a preferred embodiment. The main post 4 is substantially oval-shaped having hollow portions including tapped extruded holes 32, a center cavity 70 and "v"-shaped recesses 72. As shown in FIG. 7, the tapped extruded holes 32 of the main post 4 provide an opening for accepting long bolts 64. In a preferred embodiment, the long bolts 64 are steel and provide a strengthening support for the main post 4. The long bolts 64 extend from the bolt down plate 40 upward and beyond a cable cut-away section 62 of the main post 4, and are secured into the tapped extruded holes 32 utilizing bolt screws 66. Referring again to FIG. 2, a bolt down plate cover 30 is fitted over the bolt down plate 40.

The glass carrier extrusions 6 are fitted against "v"-shaped recesses 72 of the main post 4. Hinge pins are inserted into hinge pin holes 34 to hingedly connect the glass carrier extrusions 6 between the upper and intermediate hinge pin supports 12, 14, as shown in FIG. 1. Referring again to FIG. 2, glass carrier extrusions 6 are fitted to the glass plates 8 utilizing silicon rubber 26 to ensure a cushioned fit. FIG. 2 further illustrates cable carrier extrusions 28 and cable carrier covers 18 attached to the swivel joint castings 16, and positioned below the glass panels 8.

Figure 8:
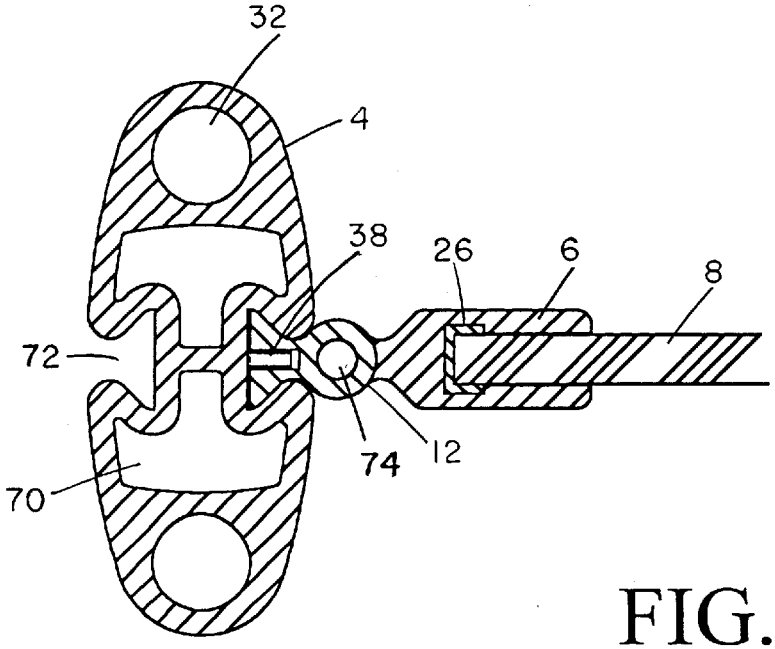
FIG. 8 is a sectional view of a main post and hinge pin support.

FIG. 8 illustrates a sectional view of a main post 4 and hinge pin support 12. The preferred embodiment of the present invention includes a center cavity 70 for reducing the weight and the material needed for extruding the main post 4. Other embodiments of the main post 4 may have smaller cavity areas, or alternatively may have a solid center portion. Carrier extrusion 6 and panel section 8 are supported between an upper hinge pin support 12 and an intermediate hinge pin support 14, shown in FIGS. 1 and 3. Hinge pin support 12 is slid into the "v"-shaped recess 72 and is held in position by jacking screw 38. Upper hinge pin 74 is inserted through the upper hinge pin support 12 to the hinge pin hole of the carrier extrusion 6 to allow the carrier extrusion 6 to rotate on the hinge pin 74.

Figure 3:
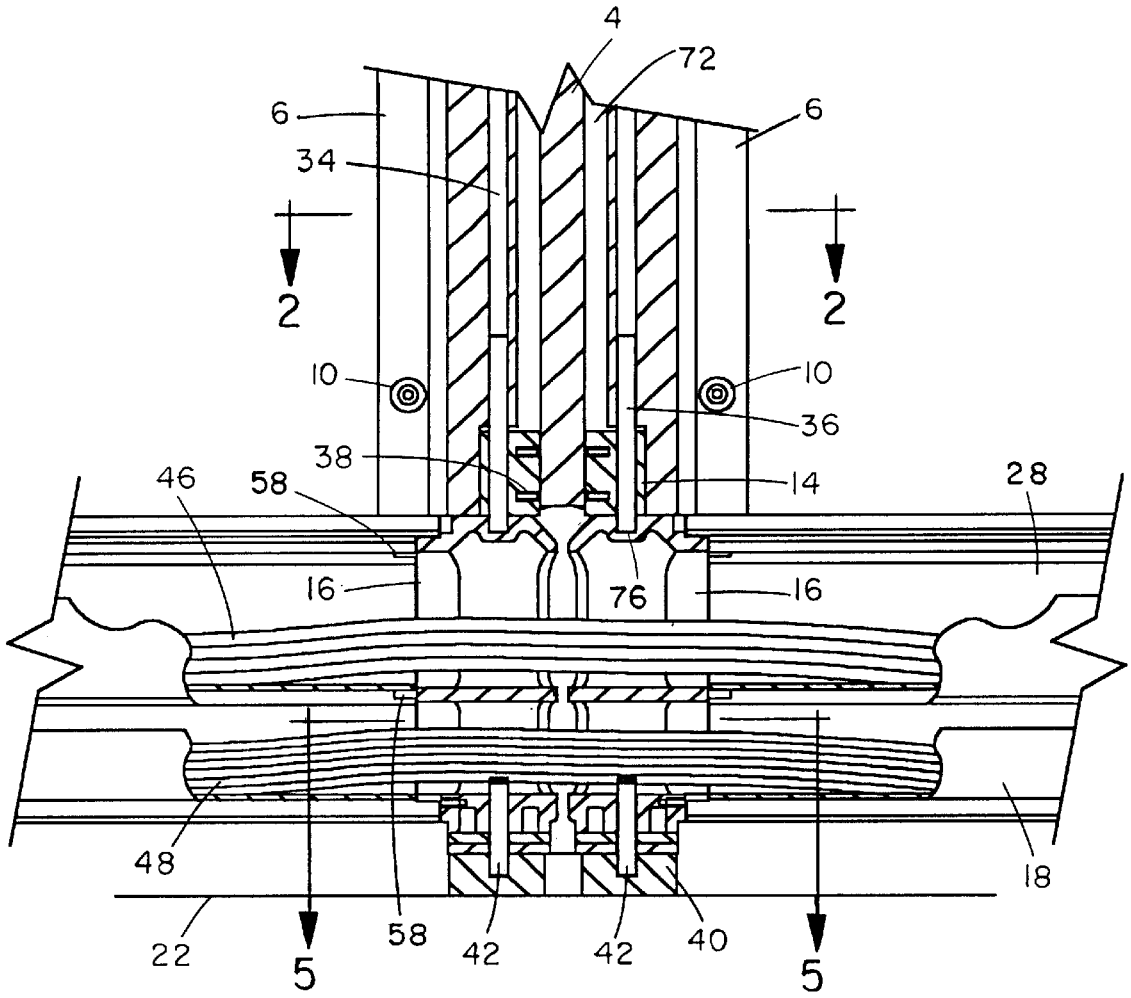
FIG. 3 is a cut-away section of the lower part of a post.
Figure 4:
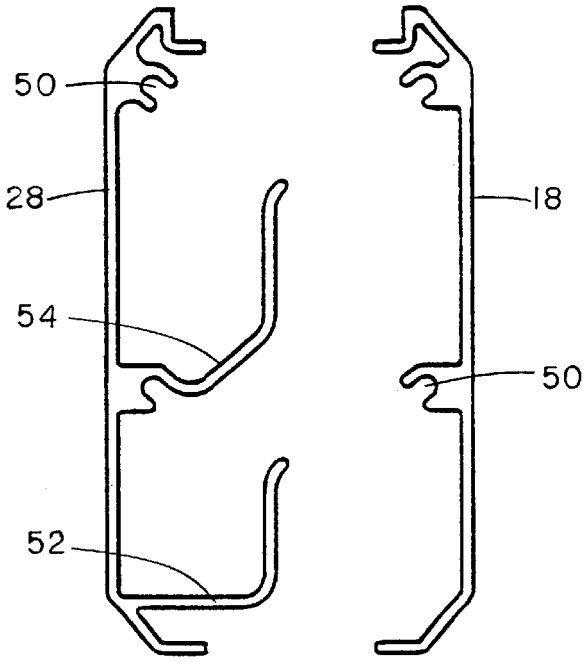
FIG. 4 is an illustration of a cable carrier extrusion section.

FIG. 3 illustrates a cut-away section of the lower portion of a main post 6 secured to a floor 22. Swivel joint castings 16 are positioned in the bottom cut-out portion of the main post 4. The swivel joint castings 16 carrying cables 46, 48 through the main posts 4 to adjacent panel sections The cable carrier cover 18 encloses multiple cables, that may include signal cables 46 and power cables 48, that are supported by a cable carrier extrusion 28. As further illustrated in FIG. 4, cable trays 52, 54 of the cable carrier extrusion 28 provide two separate areas for accepting and supporting cables. The cable cover 18 and cable carrier extrusion 50 further include location pin recesses. The pin recesses 50 mate with location pins 58 that are retained in the swivel joint casting 16, as shown in FIG. 3. Thus, the cable carrier extrusion 50 and cable cover 18 extend the channel from the swivel joint castings 16 along the length of the glass panel 8.

Continuing with FIG. 3, the swivel joint casting 16 further includes a hinge pin inset 76 for accepting an intermediate, hinge pin 36. The intermediate hinge pin 36 is inserted into the hinge pin hole 34 to hingedly attach the glass carrier extrusion 6 to the intermediate hinge pin support 14. The intermediate hinge pin 14 is positioned in the "v"-shaped recess 72 and attached to the main post 4 utilizing jacking screws 38. Security screw 10 secure the glass panels to the glass panel extrusions 6. The swivel joint casting 16 is hingedly attached to the bolt down plate 40 utilizing bolt down plate hinge pins 42 that are inset into the bolt down plate 40.

FIG. 5 illustrates a cut-away section of a cable-run 48 through joint castings 16, 16' of a main post 4 of a preferred embodiment. The swivel joint castings 16, 16' are shown at full rotation of 45 degrees to provide a 90 degree bend of the adjacent panel sections. Cables 48 run from a first cable carrier extrusion 28 to a second cable carrier extrusion 28' through a bend formed by the joint castings 16, 16'. The tray areas provided in the joint castings 16,16' ensure that the cables are not pinched when adjacent panels are angled. The cable carrier covers 18, 18' and cable carrier extrusions 28, 28' mate with the joint castings 16, 16' to prevent any exposure of the cables 48. FIG. 5 further illustrates the bolt down plate 40 and floor bolt fixing holes 56 that are utilized to bolt the plate 40 to the floor. Bolt down plate cover 30 encloses the bolt down plate 40.

FIG. 6 is a side view of a cut-away section of a cable carrier extrusion 28 and floor 22 fixtures of the preferred embodiment. Main post 4 is bolted to bolt down plate 40. Bolt down plate 40 may be bolted to a floor 22 utilizing floor bolts or studs 44 that are positioned in floor bolt fixing holes 56 of the bolt down plate 40. Joint casting 16 is positioned in the cut-away section 62 of the main post 4. Power cables 48 and signal cables 46 are supported by the power cable tray 52 and the signal cable tray 54 of the cable carrier extrusion 28. The location pin recesses 50 of the cable carrier extrusion 28 and the cable carrier cover 18 are positioned onto the joint casting 16 utilizing the location pins 58. A cable carrier retaining plate 60 is utilized to secure the cable carrier extrusion 28 and the cable carrier cover 18, and further provides a surface for additional support of the panel section 8 that is held by the class carrier extrusion 6.

The fixed barrier 2 of the preferred embodiment provides for an installation that minimizes disruption to stations, station operators, and commuters. In a preferred embodiment of the installation of the fixed barrier 2, the main post 4 is secured to the bolt down plate 40 utilizing long bolt screws 66 that are thread into the tapped extruded holes 32 of the main post 4, as shown in FIG. 7. As shown in FIG. 3, bolt down plate hinge pins 42 are positioned into the bolt down plate 40. Swivel joint castings 16 are fitted into the main post 4 cut-away section 62 onto the bolt down plate hinge pins 42. Referring to FIGS. 3 and 8, the intermediate hinge pin 36 is inset into a top portion of the joint casting 16. The intermediate hinge pin support 14 is slid down the "v"-shaped recess 72 of the main post 4 onto the intermediate hinge pin 36, and is held into place by jacking screws 38. The panel section 8 is fitted into the carrier extrusion 6 utilizing silicon rubber 26 to ensure a cushioned fit, as shown in FIG. 8. The glass carrier extrusion 16 is positioned by placing the carrier extrusion 16 against the "v"-shaped recess 72, and sliding the hinge pin hole 34 of the carrier extrusion 16 onto the intermediate hinge pin 36. The upper hinge pin support 12 then is fitted down the "v"-shaped wedge of the main post 4 and clamped into position utilizing jacking screws 38. The upper hinge pin 74 is placed through the upper hinge pin support 12 to the hinge pin hole 34 of the carrier extrusion 6.

Referring to FIGS. 1 and 6, the bolt down plate assembly 20, including bolt down plate 40 and floor bolts or studs 44, is secured to the floor 22 at a desired pitch. Location pins 58 are placed into the swivel joint casting 16, and the location pin recesses 50 of the cable carrier extrusion 28 are placed onto the swivel joint casting at the location pins 58 The power and signal cables 46, 48 are run through the joint casting 16 and placed in the power and signal cable trays 52, 54 of the cable carrier extrusion 28. A cable carrier cover 18 placed over the cables, and the cable carrier retaining pate 60 is positioned, as shown in FIG. 6. A bolt down plate cover 30 is positioned over the bolt down plate, as shown in FIGS. 2 and 5. The fixed barrier 2 module is completed by placing a top plate and cap 24 onto the main post 4, as shown in FIG. 1.

After a first main post 4 is installed, the panels are hinged to a desired angle, and adjacent barrier modules are assembled similarly after aligning and positioning each adjacent main post 4 to the panel of a previously-installed main post 4. Obviously, the order of assembly of the fixed barrier 2 may be varied, and other embodiments and modifications of the present invention will occur readily to those of ordinary skill in the art in view of these teachings. Such persons will appreciate the symmetries among the various embodiments of the fixed barrier illustrated above and understand that the elements of the fixed barrier may be arranged in other ways to produce similar results Therefore, this invention is to be limited only by the following claims, which include all such other embodiments and modifications when viewed in conjunction with the above specification and accompanying drawings.

We claim:

1. A fixed barrier comprising:

at least two support posts for supporting at least one panel, each support post of the at least two support posts having a first side and a second side defined by an axis along the length of each support post, each support post having bolt holes for accepting attaching means for attaching the support post to a fixable structure;

at least one panel carrier extrusion attachable to one of the first side and the second side of each support post at an upper hinge and a lower hinge utilizing an upper and lower hinge pin;

at least one panel for mating with the at least one panel carrier extrusion;

at least one joint casting for carrying cables through one of the first side and the second side of each support post, the at least one joint casting independently rotatable within a lower portion of one of the first side and the second side of each support post; and a cable carrier attachable to the at least one joint casting and positioned below the at least one panel carrier extrusion, the cable carrier for carrying the cables from a first post of the at least two support posts to an adjacent post of the at least two support posts;

wherein the at least one panel and the at least one joint casting cooperate to rotate to a desired angle.

2. The fixed barrier of claim 1, wherein the at least one panel carrier extrusion comprises a first panel carrier extrusion attachable to the first side and a second panel carrier extrusion attachable to the second side, wherein the at least one panel comprises a first panel for mating with the first panel carrier extrusion and a second panel for mating with the second panel carrier extrusion, and wherein the at least one joint casting comprises a first joint casting rotatable within the first side of each support post and a second joint casting rotatable within the second side of each support post, the first joint casting independently rotatable from the second joint casting.

3. A barrier system for providing a barrier and carrying cables, the barrier system comprising:

a plurality of panels, each panel of the plurality of panels comprising a cable-carrying channel;

a plurality of posts for hingeably supporting the plurality of panels, wherein each post of the plurality of posts supports a first and second panel of the plurality of panels, and wherein a single panel of the plurality of panels is supported between a first and second post of the plurality of posts;

a plurality of rotatable joint castings comprising a first rotatable joint casting and a second rotatable joint casting positioned in each post adjacent the cable-carrying channels of the first and second panel, the first and second rotatable joint castings aligned in a plane perpendicular to a vertical axis of each post and having channels that are at least partially aligned along the perpendicular plane to carry the cables from the first panel through each post to the second panel, wherein the first rotatable joint casting rotates independently from the second rotatable joint casting;

connection means for connecting the first rotatable joint casting with the first panel and the second rotatable joint casting with the second panel, wherein the connection means provides cooperative rotation of the first rotatable joint casting and first panel and cooperative rotation of the second rotatable joint casting and the second panel;

wherein the plurality of hingeable panels and the plurality of rotatable joint castings allow the barrier system to follow a desired contour.

4. The barrier system of claim 3, further comprising floor bolting means for bolting the plurality of posts to a floor.

5. The barrier system of claim 3, wherein the cable-carrying channel is located across a bottom portion of each panel.

6. The barrier system of claim 3, wherein the plurality of panels are constructed of a transparent material.

7. The barrier system of claim 3, wherein the plurality of posts and the plurality of rotatable joint castings are aluminum.

8. The barrier system of claim 3, wherein the plurality of posts and the plurality of rotatable joint castings are plastic.

9. A universal post for supporting at least one panel of a fixed barrier, the universal post comprising:

a main post having a vertical axis defining a right post portion and a left post portion, the main post comprising:

an upper portion having means for attaching at least one hingeable panel carrier extrusion to one of the right and left post portions, the at least one hingeable panel carrier extrusion for attaching the at least one panel; and a lower portion having a cut-away section through the right and left post portions of the main post; and at least one swivel joint positioned adjacent the vertical axis in one of the right and left post portions in the cut-away section for carrying cables through one of the right and left post portions of the main post, the at least one swivel joint rotatable within one of the right and left post portions of the main post;

wherein the at least one hingeable panel carrier extrusion and the at least one swivel joint are attachable such that the at least one panel and the at least one swivel joint rotate together.

10. The universal post of claim 9, wherein the at least one hingeable panel carrier extrusion comprises a first and a second panel carrier extrusion for attaching a first panel and a second panel respectively of the at least one panel, and wherein the at least one swivel joint comprises a first swivel joint rotatable within the right post portion and a second swivel joint rotatable within the left post portion, the first swivel joint and the first panel carrier extrusion rotatable independent of the second swivel joint and the second panel carrier extrusion to allow the first panel to be rotated to a first angle and the second panel to be rotated to a second angle.

11. The universal post of claim 9, wherein means for attaching at least one hingeable panel carrier extrusion is a hinge having a hinge pin hole.

12. The universal post of claim 11, wherein the hinge is attached to the main post utilizing jacking screws.

13. The universal post of claim 9, wherein the lower portion further comprises a swivel joint hinge pin, and wherein the swivel joint comprises an inset for rotating on the swivel joint hinge pin.

14. An apparatus for carrying power and signal cables within a panel section and a support post of a fixed barrier line, the support post having a lengthwise center axis defining a first half and a second half of the support post, the apparatus comprising:

at least one swivel casting for attachment inside a first half of the support post, the at least one swivel casting having a through hole for accepting and carrying the power and signal cables through the first half of the support post, the at least one swivel casting rotatable within the first half of the support post; and a cable carrier extrusion attachable below the panel section for carrying the power and signal cables from the at least one swivel casting of the support post through the panel section, the cable carrier extrusion connectable to the at least one swivel casting for cooperative rotation.

15. The apparatus of claim 14, wherein the at least one swivel casting comprises a first casting in the first half of the support post adjacent a second casting in a second half of the support post, and wherein the first and second casting are independently rotatable.

16. A support post assembly for enabling a plurality of panels of a fixed barrier line to change direction, the support post assembly comprising:

at least one hinging means for hingeably attaching a first panel of the plurality of panels on a first side of the support post assembly; and at least one swivel joint rotatable within the first side of the support post assembly, the at least one swivel joint comprising:

a top surface having attachment means for attaching the at least one swivel joint to a lower end one of the at least one hinging means;

a bottom surface having a swivel joint rotation means for rotating the at least one swivel joint in unison with the at least one hinging means; and a channel between the top surface and bottom surface for carrying cables through the first side of the support post assembly.

17. The support post assembly of claim 16, further comprising:

a second hinging means for hingeabley attaching a second panel of the plurality of panels on a second side of the support post assembly; and a second swivel joint for rotatable within the second side of the support post assembly, the second swivel joint attachable to the second hinge means and aligned with the first swivel joint in a plane perpendicular to the support post;

wherein the first and second swivel joint are independently rotatable to allow the first panel to be angled at a desired angle with respect to the second panel.

18. The support post assembly of claim 17, wherein the desired angle is 90 degrees.

19. A fixed barrier module comprising:

at least one post having a vertical axis defining a first lengthwise portion and a second lengthwise portion, the at least one post having a cut-away section through the first and second lengthwise portion of the post along a plane perpendicular to the vertical axis;

at least one panel hingeably attachable to one of the first lengthwise portion and the second lengthwise portion of the at least one post, the at least one panel having a cable-carrying channel aligned with the cut-away section for carrying a plurality of cables along the perpendicular plane; and at least one swivel casting positioned in one of the first lengthwise portion and the second lengthwise portion of the cut-away section, the at least one swivel casting attachable to the at least one panel and having means for rotation to a maximum rotation angle within the cut-away section, the at least one swivel casting having a swivel casting channel aligned with the cable-carrying channel for carrying the plurality of cables through the at least one swivel casting.

20. The fixed barrier module of claim 19, wherein in the at least one swivel casting comprises a first swivel casting in tandem in the perpendicular plane with a second swivel casting, the first swivel casting independently rotatable from the second swivel casting, wherein the swivel casting channels of the first and second swivel castings are at least partially aligned through the maximum rotation angle.

* * * * *